US007513713B2

(12) United States Patent
Thomas et al.

(10) Patent No.: US 7,513,713 B2
(45) **Date of Patent: *Apr. 7, 2009**

(54) STRUCTURE FOR TRANSPORTING, COMMISSIONING AND DECOMMISSIONING OF A DECK OF A FIXED OIL PLATFORM AND METHOD FOR IMPLEMENTING THE STRUCTURE

(75) Inventors: Pierre-Armand Thomas, Puteaux (FR); Pal Teien, Moss (NO)

(73) Assignee: Technip France (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/508,467

(22) PCT Filed: Mar. 6, 2003

(86) PCT No.: PCT/FR03/00723

§ 371 (c)(1),
(2), (4) Date: Sep. 21, 2004

(87) PCT Pub. No.: WO03/080425

PCT Pub. Date: Oct. 2, 2003

(65) Prior Publication Data

US 2005/0158125 A1 Jul. 21, 2005

(30) Foreign Application Priority Data

Mar. 22, 2002 (FR) ..... 02 03637

(51) Int. Cl.
*B63B 35/44* (2006.01)
*E02B 17/08* (2006.01)

(52) U.S. Cl. ..... 405/203; 405/196

(58) Field of Classification Search ..... 405/196, 405/197, 199, 201, 203, 204, 209
See application file for complete search history.

(56) References Cited

U.S. PATENT DOCUMENTS

| | | | | |
|---|---|---|---|---|
| 3,830,071 | A * | 8/1974 | LeTourneau | 405/197 |
| 3,967,457 | A | 7/1976 | Lovie | |
| 4,382,718 | A * | 5/1983 | Inoue et al. | 405/196 |
| 4,431,343 | A * | 2/1984 | Uchiyama et al. | 405/198 |
| 4,456,404 | A * | 6/1984 | Evans | 405/196 |

(Continued)

FOREIGN PATENT DOCUMENTS

| | | | |
|---|---|---|---|
| JP | 57-9911 | * | 1/1982 |

(Continued)

*Primary Examiner*—Sunil Singh
(74) *Attorney, Agent, or Firm*—Ostrolenk, Faber, Gerb & Soffen, LLP

(57) ABSTRACT

A structure for the transport, installation and dismantlement of a deck (2) of a fixed oil platform (1) for maritime use, the structure including a floating U-shaped hull (11) fitted with at least three lifting legs (12) adapted so as to rest upon the bottom of the sea, each lifting leg (12) being associated with mechanical displacement units (20), and a shuttle (30) which can be displaced along the lifting legs (12) by the hull (11) and which is applied to the lower surface of the deck (2) in a support position for the deck, the shuttle (30) being provided with locks (36, 37) for locking on the lifting legs (12). A method for the transport, installation and dismantlement of a deck of a fixed oil platform is also disclosed.

20 Claims, 9 Drawing Sheets

U.S. PATENT DOCUMENTS

| | | | | | |
|---|---|---|---|---|---|
| 4,813,814 | A * | 3/1989 | Shibuta et al. | 405/198 |
| 5,224,798 | A * | 7/1993 | Thomas | 405/198 |
| 5,855,455 | A | 1/1999 | Williford et al. | |
| 6,840,713 | B1 * | 1/2005 | Schia et al. | 405/209 |
| 2008/0131209 | A1 * | 6/2008 | Thomas | 405/198 |

FOREIGN PATENT DOCUMENTS

| | | | |
|---|---|---|---|
| JP | 58-160427 | * | 9/1983 |
| JP | 62017218 A | * | 1/1987 |
| JP | 63-44010 | * | 2/1988 |

* cited by examiner

STRUCTURE FOR TRANSPORTING, COMMISSIONING AND DECOMMISSIONING OF A DECK OF A FIXED OIL PLATFORM AND METHOD FOR IMPLEMENTING THE STRUCTURE

PRIORITY CLAIM

This is a U.S. national stage of application No. PCT/FR03/00723, filed on 6 Mar. 2003.

Priority is claimed on that application and on the following application:

Country: France, Application No. 02/03637, Filed 22 Mar. 2002.

The PCT International application was published in the French language.

BACKGROUND OF THE INVENTION

The present invention relates to a structure for the transport, commissioning and decommissioning of a deck of an offshore fixed oil production platform. Moreover, it relates to a method for the transport, commissioning and decommissioning of a deck of a fixed oil platform.

A known approach to oil production is to install above an oil field a fixed oil platform with a deck carrying production equipment and accommodation premises, in particular. A column anchored to the seabed supports the deck.

To date, there are two major methods for the transport, commissioning and decommissioning of a fixed oil platform deck.

The first method involves using barge-mounted lifting cranes for transfering the oil platform deck from the transport vessel to a superstructure comprising a supporting column. Although this method has been the most widely used to date, it has limitations.

The first limitation is effectively the capacity of the lifting cranes, which may require the deck to be fabricated in several units, thereby significantly increasing the fabrication cost of the oil platform deck and the cost of commissioning and decommissioning said deck.

The second limitation lies in the fact that this method imposes the need for a relatively long favorable time window to be able to perform this operation at sea under satisfactory conditions.

Without incurring a considerable increase in cost, this method is difficult to implement in areas in which time windows are relatively short, for example in the North Sea.

The second method involves commissioning the oil platform deck in a single unit by causing it to float over the supporting column. The deck is then positioned on this supporting column either by a ballasting/deballasting system or by a mechanical system.

In the case of a ballasting system, the oil platform deck is supported either by a floating support comprising, for example, a barge or pontoons or a U-shaped floating support, or by using a structure associated with this floating support.

In cases in which the superstructure can be ballasted or deballasted, deballasting of the floating support and ballasting of the superstructure is a known approach used to decommission an oil platform deck. The decommissioning operation can be performed relatively quickly because the superstructure offers a large ballasting capacity. In cases in which the superstructure is anchored to the seabed, only the deballasting capacity of the floating support can be used. The operation progresses slowly because this capacity is limited.

Systems using ballasting or deballasting have drawbacks due mainly to the fact that they require a complex structure in terms of chambers or pumps and very accurate control of chamber filling and emptying to maintain floating support stability during the operation. Operation speed depends on the ballasting and deballasting capacity of these floating support chambers, which is generally rather low inasmuch as the operation speed is often limited, especially when the superstructure is anchored to the seabed. Furthermore, maritime conditions must be favorable in order to perform such an operation in satisfactory conditions.

An alternative to the ballasting/deballasting system is to use a mechanical system to raise or lower the oil platform deck. These systems enable an oil platform deck commissioning or decommissioning operation to be performed faster than the abovementioned systems.

For this purpose, a known approach involves a system including two barges that support the oil platform deck using two swiveling structures. Furthermore, a cable and winch system is used to ensure system stability and control the raising and lowering of the oil platform deck.

Barge clearance is controlled by actuating these winches, thereby allowing the deck to be raised or lowered. However, the stability of this type of mechanical system is very insecure and it is frequently incompatible in relation to open sea use.

Another mechanical system comprises a rack and pinion system for raising or lowering the oil platform deck.

In general, mechanical systems used to date for commissioning and decommissioning an oil platform deck are faster than ballasting or deballasting systems, but they are dependent on maritime conditions, which makes them difficult to use in areas in which favorable time windows are relatively short.

SUMMARY OF THE INVENTION

The object of the invention is to overcome these drawbacks by proposing a structure for the transport, commissioning or decommissioning of a fixed oil platform deck that has been designed to facilitate different operations, whilst achieving a significant saving of time, avoiding any risk of polluting the environment and increasing the safety of personnel in charge of performing the various operations.

For this purpose, the subject of the invention is a structure for the transport, commissioning and decommissioning of a deck of an offshore fixed oil production platform, characterized in that it comprises:

- a U-shaped floating hull fitted with at least three hull lifting legs, adapted so as to rest upon the seabed, each leg being associated with mechanical displacement means, and
- a shuttle which can be displaced along said lifting legs by the hull and is intended to be applied to the lower surface of the deck in a support position for said deck, said shuttle being provided with means for locking on the lifting legs.

Depending on the specific implementation methods:

- mechanical displacement means comprise, on the one hand, two opposing plates supported by the corresponding lifting leg and each featuring on both its lateral faces a set of teeth and, on the other hand, at least two opposing units supported by the hull and each made up of a pinion driven rotationally and operating in conjunction with one of the sets of teeth,
- the shuttle is made up of at least three independent units, each associated with one leg through guidance means and featuring lateral stabilization devices for the deck in its support position, each shuttle unit includes a vertical branch, whose top section features guidance and locking means for positioning the unit on the hull and a horizontal branch for supporting the deck, the guidance means are formed by two opposing flanges, each determining, in conjunction with the vertical branch, a housing for one plate on the corresponding leg, the locking means comprise at least one counterlocking rack, which can be displaced by at least one actuation device between a retracted position and a locked position engaging one of the sets of teeth on the corresponding leg, the stabilization devices include at least one hydraulic or pneumatic horizontal displacement cylinder for each shuttle unit, the hull features rails for sliding the deck horizontally between a position supported on the shuttle units and a storage position outside the structure.

A further subject of the invention is a method for decommissioning and transporting a fixed oil platform deck from a production site to a deck disassembly quay, characterized in that it comprises the following stages:

positioning beneath the deck a transport structure featuring a U-shaped floating hull fitted with at least three hull lifting legs and a shuttle which can be displaced along these lifting legs by said hull, applying the lifting legs to the seabed, raising the hull and the shuttle to bring said shuttle into contact with the deck, separating the deck from its supporting column, lifting the deck by means of the hull and the shuttle, locking the shuttle onto the structure lifting legs and laterally stabilizing the deck on the shuttle, lowering the hull to bring it into floatation, continuing hull lowering to cause the structure lifting legs to rise by reaction, displacing the deck supporting structure to release said deck from the supporting column, applying the lifting legs to the seabed and raising the hull to bring it into contact with the shuttle, unlocking the shuttle from the structure lifting legs, lowering the hull supporting the shuttle and the deck to bring it into floatation, raising the structure lifting legs, floating the deck supporting structure as far as the disassembly quay, applying the lifting legs to the seabed to stabilize the hull, releasing the deck from the structure, ensuring the link between the hull surface and the quay, and offloading the oil platform deck onto the quay.

A further object of the invention is a method for transporting from a quay to a production site and commissioning a fixed oil platform deck, characterized in that it comprises the following stages:

floating near to a quay a transport structure featuring a U-shaped floating hull fitted with at least three hull lifting legs and a shuttle, which can be displaced along these legs by said hull, applying the lifting legs to the seabed to stabilize the hull, ensuring the link between the hull surface and the quay, transfering the deck from the quay to the structure shuttle and laterally stabilizing the deck on this shuttle, raising the lifting legs, floating the structure until it is near to the production site, applying the lifting legs to the seabed, lifting the deck by means of the hull and the shuttle, locking the shuttle onto the structure lifting legs and lowering the hull to bring it into floatation, raising the structure lifting legs, positioning the deck above the oil platform supporting column and applying the lifting legs to the seabed, raising the hull to bring it into contact with the shuttle and unlocking said shuttle, lowering the hull, the shuttle and the deck to place this deck on the supporting column, fixing the deck to the supporting column, lowering the hull and the shuttle to bring said hull into floatation, raising the structure lifting legs, and removing the structure from the production site.

BRIEF DESCRIPTION OF THE DRAWINGS

The invention will be better understood on reading the following description, provided only as an example and made in reference to the appended drawings, in which.

DESCRIPTION OF A PREFERRED EMBODIMENT

Figure 1:
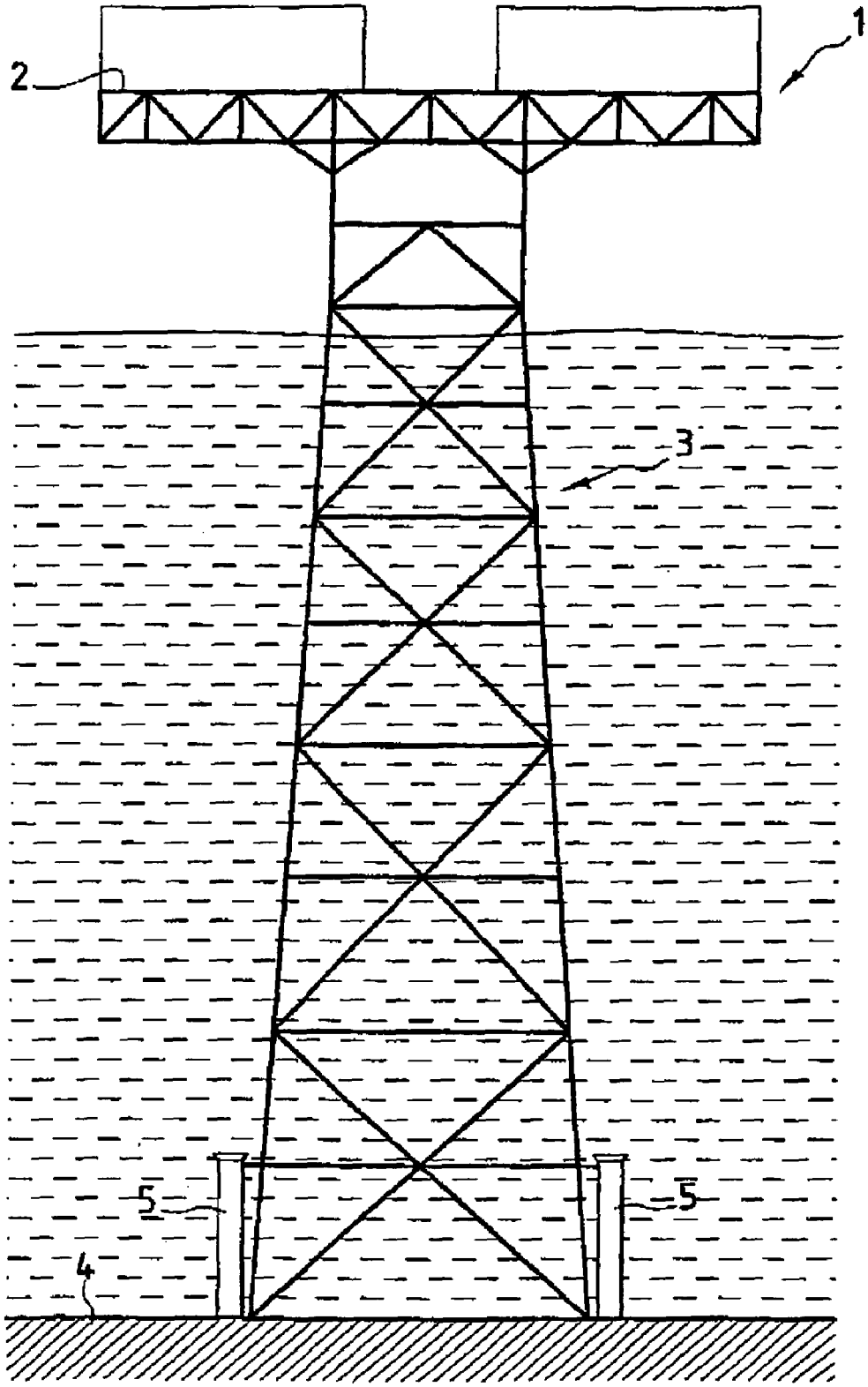
FIG.1 PRIOR ART
FIG. 1 is a diagrammatic elevation view of a fixed oil platform in production position.

A fixed oil platform designated generally by reference 1 and including a deck 2, featuring customary production equipment and accommodation premises, is diagrammatically represented in FIG. 1. This deck 2 is mounted on a supporting column 3, whose base is anchored to the seabed 4 by anchorage devices 5.

Figure 2:
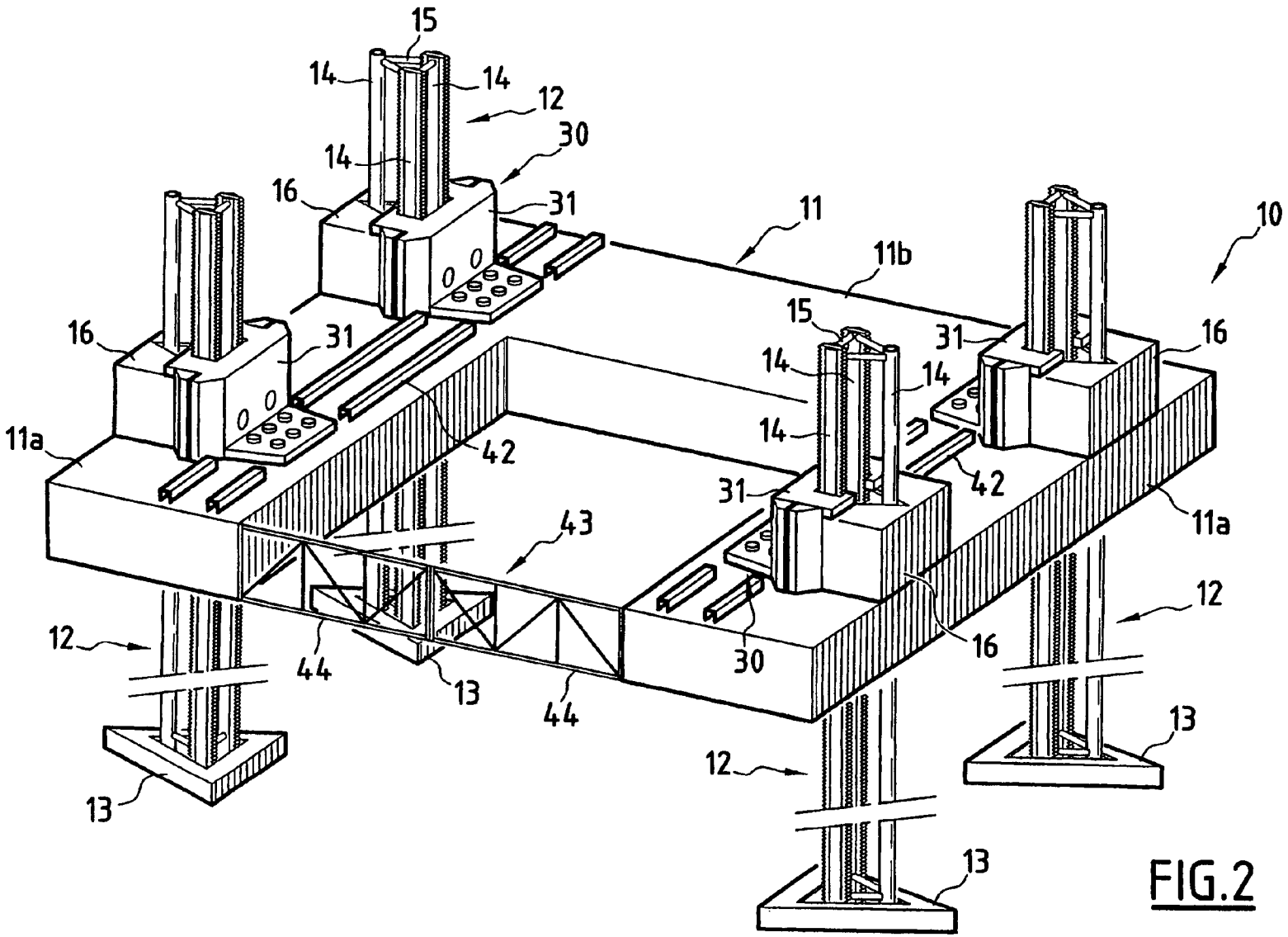
FIG. 2 is a diagrammatic perspective view of a structure for transport, commissioning and decommissioning according to the invention.

A structure designated by general reference 10 and represented in FIG. 2 is used to ensure the transport of the deck 2 of the fixed oil platform 1 from a production site to a disassembly quay or vice versa, as well as the commissioning and decommissioning of said deck 2.

General structural dimensions and proportions between the various units making up this structure 10 have not necessarily been respected in FIG. 2, to simplify understanding of the drawing.

In general, the structure 10 includes a U-shaped floating hull 11 fitted with lifting legs 12 for this hull 11, adapted so as to rest upon the seabed. The hull 11 features two lateral sections 11*a* and a link section 11*b* connecting the two lateral sections 11*a*.

In the construction example represented in FIG. 2, the hull 11 is fitted with four lifting legs 12 arranged in pairs on each lateral branch 11*a* of said hull 11.

In an alternative embodiment, the hull 11 may be fitted with three lifting legs 12 arranged in a triangle, one leg 12 being located on each lateral section 11*a* and one leg 12 being located on the link section 11*b*.

The bottom end of each leg 12 terminates with a shoe 13 designed to bear on the seabed 4.

In this construction method, each leg 12 has a triangular section as represented in FIG. 2. These legs 12 may also have a square or circular section.

Each leg 12 is made up of three chords 14 interlinked by a lattice of steel beams 15.

Figure 4:
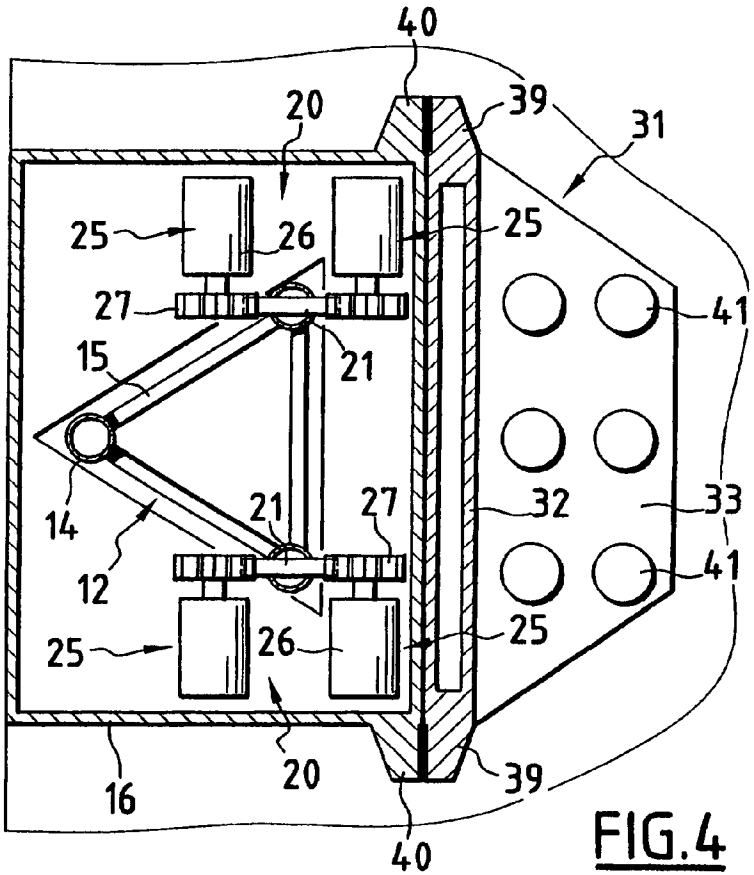
FIG. 4 is a sectional view along line 4-4 in FIG. 3.
Figure 3:
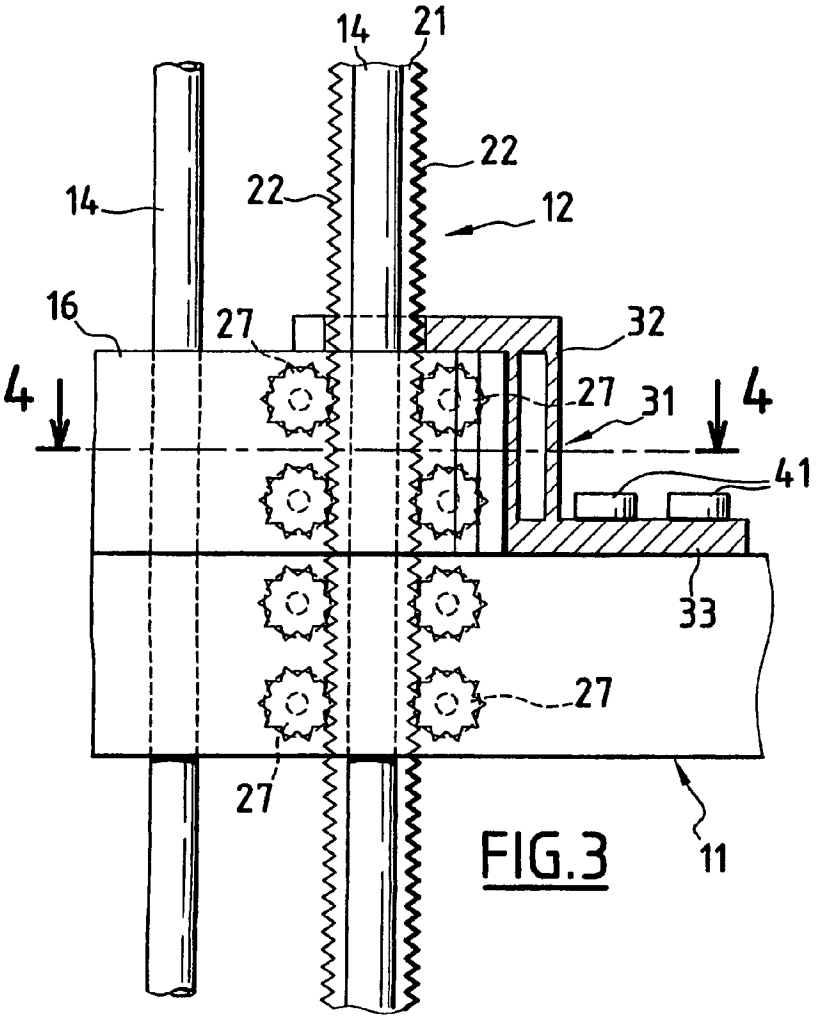
FIG. 3 is a partial vertical sectional view of mechanical means for displacing the structure.

Each leg 12 is associated with mechanical displacement means designated by general reference 20 (FIGS. 3 and 4).

The mechanical displacement means 20 for each leg 12 are located inside a supporting framework 16, also called a "jack-house" by specialists, which itself is supported by the hull 11.

As represented in FIGS. 3 and 4, mechanical displacement means 20 for each leg 12 comprise, on the one hand, two opposing plates 21, each supported by a chord 14 of the corresponding leg 12 and each featuring on both its lateral faces a set of teeth 22 forming a double rack on both chords 14. Mechanical displacement means 20 also comprise several units 25 arranged on either side of each plate 21 according to its height. Each unit 25 includes a geared motor unit 26 driving a pinion 27, which engages with a set of teeth 22 on the corresponding plate 21. In the construction method represented in FIGS. 3 and 4, both sets of teeth 22 on each plate 21 are associated with eight pinions 27, each driven rotationally by a geared motor unit 26.

The structure 10 also features a shuttle designated by general reference 30, which can be displaced along the legs 12 by the hull 11 and is intended to be applied to the bottom face of deck 2 of oil platform 1, as will be seen later.

The shuttle 30 is made up of independent units 31, whose number corresponds to the number of legs 12 of the structure 10, as represented in FIG. 2. Thus, in the construction example represented in the figures, the shuttle 30 is made up of four independent units 31, each associated with one lifting leg 12.

In an alternative embodiment, the shuttle 30 may also comprise a single unit in the form of a frame supported by lifting legs 12 using mechanical displacement means 20.

In reference to FIGS. 3 to 6, a description will be given of one independent unit 31 of the shuttle 30, the other independent units 31 being identical.

The unit 31 includes a vertical branch 32 for positioning the unit on a lateral face of the supporting framework 16 of the hull 11 and a horizontal branch 33 for supporting the deck 2 during transport. The vertical branch 32 features guidance means along the corresponding leg 12 and means of locking onto the leg 12.

Two opposing flanges 34 located in the top section of the vertical branch 32 and extending parallel to the horizontal branch 33 of the unit 31 form guidance means. Each flange 34 determines, in conjunction with said vertical branch 32, a housing 35 for one plate 21 on the corresponding leg 12. Each unit 31 is thereby guided along the corresponding leg 12 by plates 21.

Figure 6:
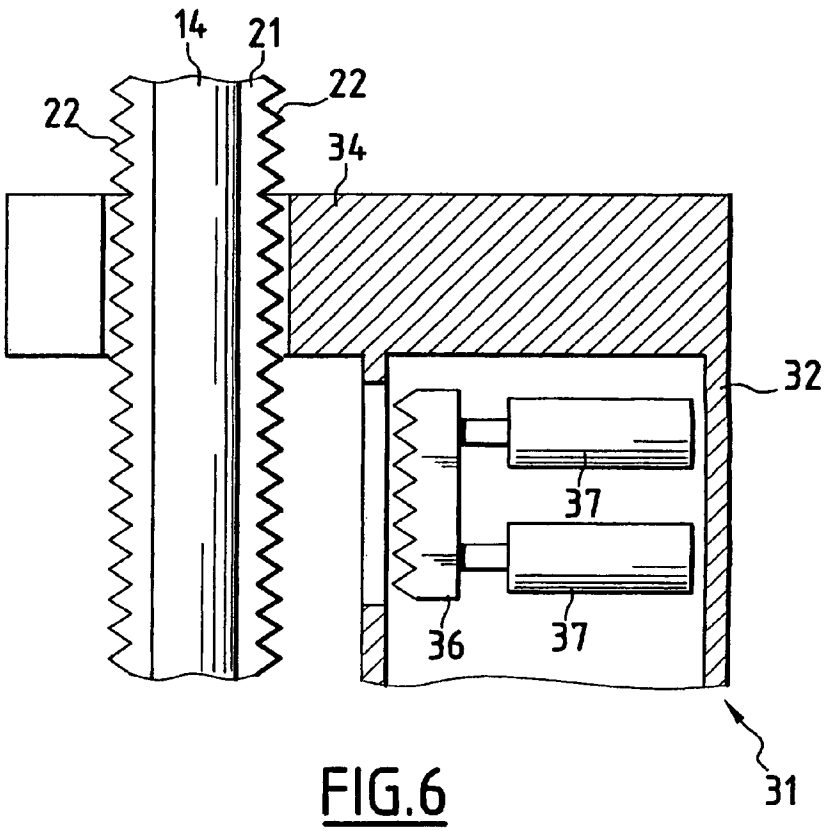
FIG. 6 is a diagrammatic vertical sectional view of locking means for a shuttle unit.

As represented by FIG. 6, means of locking each unit 31 are formed by at least one counterlocking rack 36 and, preferably, by at least one counterlocking rack 36 for each plate 21. The counterlocking rack 36 can be displaced by at least one actuation device 37 and preferably by two actuation devices 37 composed of, for example, hydraulic or pneumatic cylinders to displace the counterlocking rack 36 between a retracted position and a locked position engaging one of the sets of teeth 22 on the corresponding leg 12. The combination formed by the counterlocking rack 36 and actuation devices 37 is carried by the unit 31 using appropriate fixing devices, which are not represented.

Furthermore, each unit 31 of the shuttle 30 is fitted with devices ensuring lateral stabilization of the deck 2 in its supported position. These devices are formed by at least one hydraulic or pneumatic horizontal displacement cylinder 38 located, for example, in the vertical branch 32 of said unit 31.

Figure 5:
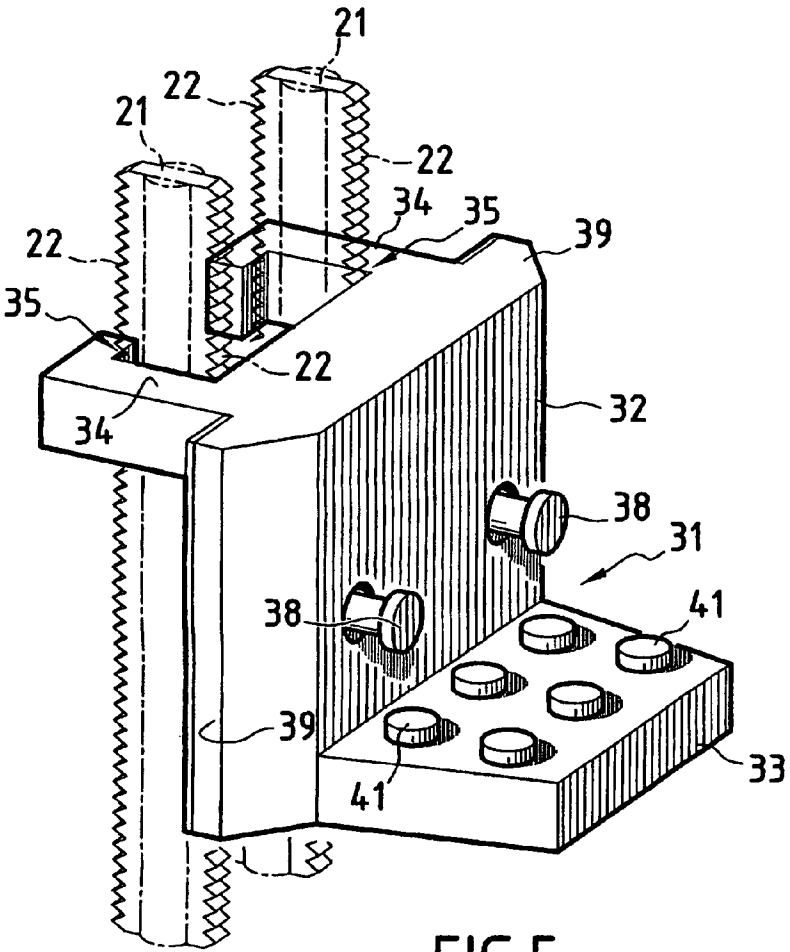
FIG. 5 is a diagrammatic perspective view of a structure shuttle unit according to the invention.

As represented, in particular in FIGS. 4 and 5, each unit 31 is provided with two slideways 39, each extending vertically along the lateral edge of the vertical branch 32. Each slideway 39 operates in conjunction with a vertical slideway 40, fixed to the framework 16 at each lifting leg 12. Opposing faces of the slideways 39 and 40 are provided with an anti friction lining made of "Teflon", for example.

Finally, the top face of the horizontal branch 33 of each unit 31 features elastic bearing devices 41 for the deck 2 of the oil platform 1. These elastic devices 41 comprise, for example, elastomer blocks or inflatable cushions or any other suitable system.

As represented in FIG. 2, the top face of the hull 11 is fitted with rails 42 extending in the same direction as the lateral sections 11*a* of said hull 11, which allow the deck 2 to slide horizontally, after it has been placed on said hull 11, between its position supported on the units 31 of the shuttle 30 and a storage position outside the structure 11, for example on a port quay, to allow safe disassembly of the deck 2 for personnel or vice versa, in other words transfer of the deck 2 from a quay onto the units 31 of the shuttle 30 for transport of the deck 2 to the production site.

Finally, the open part of hull 11 features a door 43 formed by, for example, two gates 44 which can be moved from an open position for positioning the structure 10 beneath the deck 2 to a closed position during transfer of said deck 2 by the structure 10.

Transport of the deck 2 by the structure 10 between the production site and a port quay is performed in the following way.

Figure 7A:
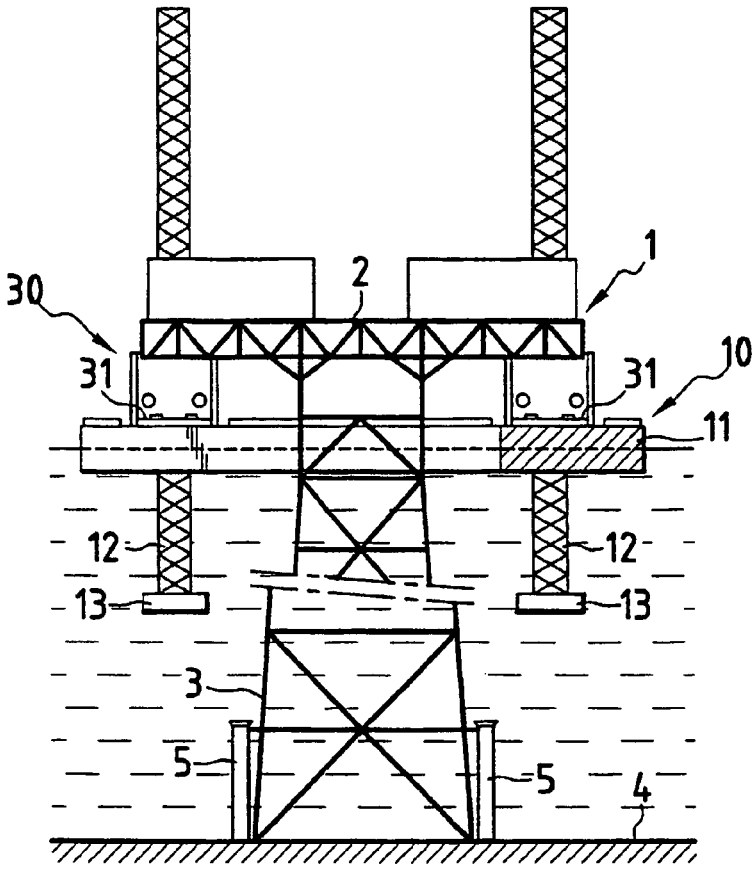
FIGS. 7A to 7J are diagrams showing the various stages of the method according to the invention.
Figure 7B:
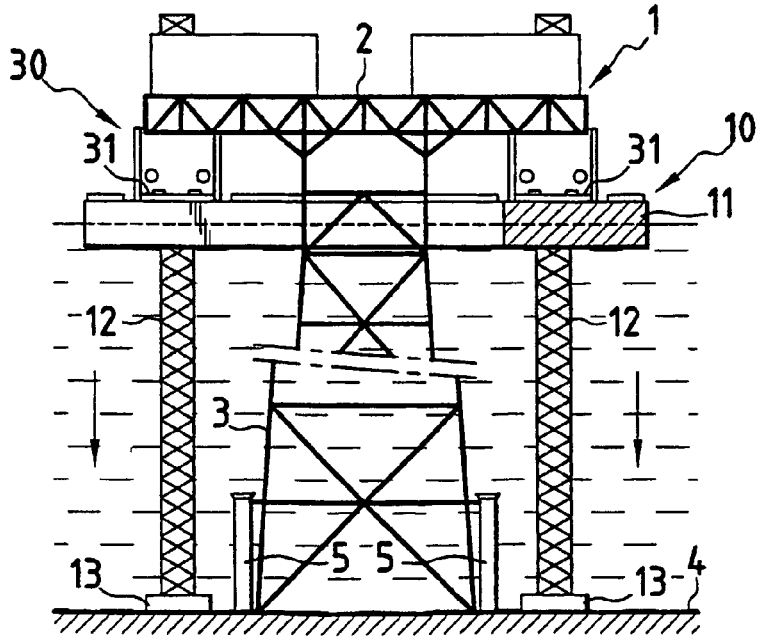

First and foremost, as represented by FIG. 7A, the structure 10 is floated with the gates 44 in an open position beneath the deck 2 of the oil platform 1 by positioning the supporting column 3 for the deck 2 in the U-shaped space created between the lateral sections 11*a* of the hull 11. During this positioning, the lifting legs 12 are in a retracted position such that the shoes 13 are located beneath the hull 11. The units 31 of the shuttle 30 are applied against the hull 11, as represented in particular by FIG. 2.

Geared motor units 26 are then actuated to rotationally drive the pinions 27, which engage with sets of teeth 22 on plates 21 in each lifting leg 12 to bring the shoes 13 into contact with the seabed 4.

As soon as the shoes 13 contact the seabed 4, the hull 11 moves upward along the lifting legs 12 under the effect of the rotational driving of the pinions 27, which engage with sets of teeth 22 on plates 21 in each lifting leg 12. By moving upward, the hull 11 lifts the shuttle 30 to apply elastic devices 41 of each unit 31 against the bottom face of the deck 2. Driving of the pinions 27 is stopped and the counterlocking racks 36 are actuated by the cylinders 37 to make these counterlocking racks 36 engage with the adjacent teeth 22 to lock each unit 31 of the shuttle 30 onto the lifting legs 12, as represented in FIG. 7C.

Figure 7C:
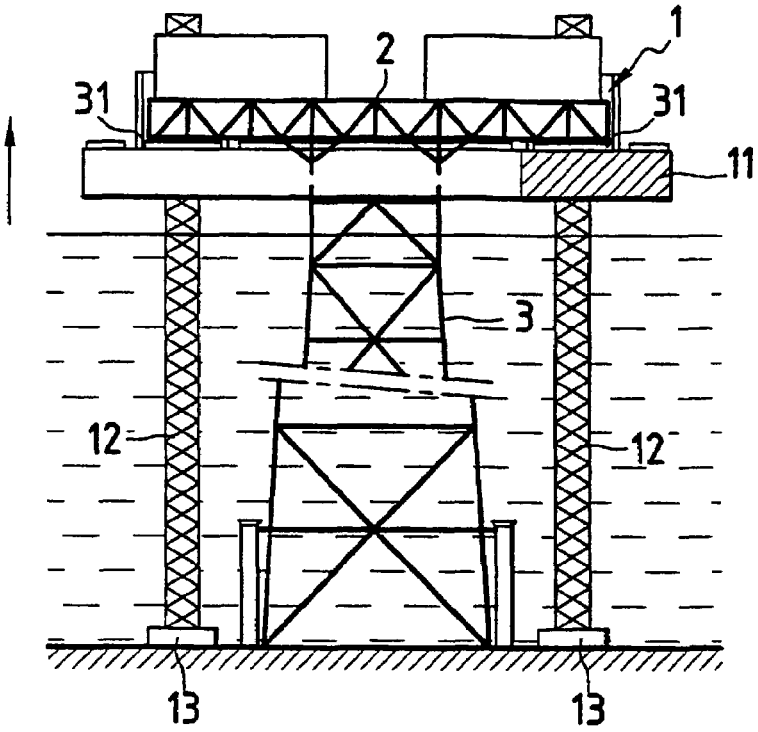

The supporting column 3 is then separated from the deck 2, for example by cutting its connecting rods, and the combination comprising hull 11, shuttle 30 and deck 2 is lifted to separate the deck 2 from the supporting column 3, which remains in a vertical position, as represented in FIG. 7C.

Figure 7D:
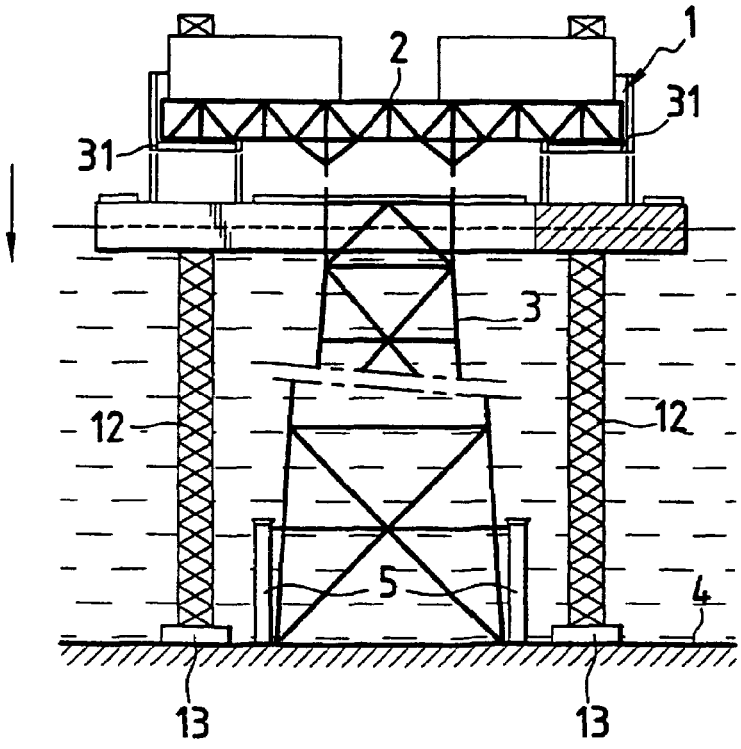
Figure 7E:
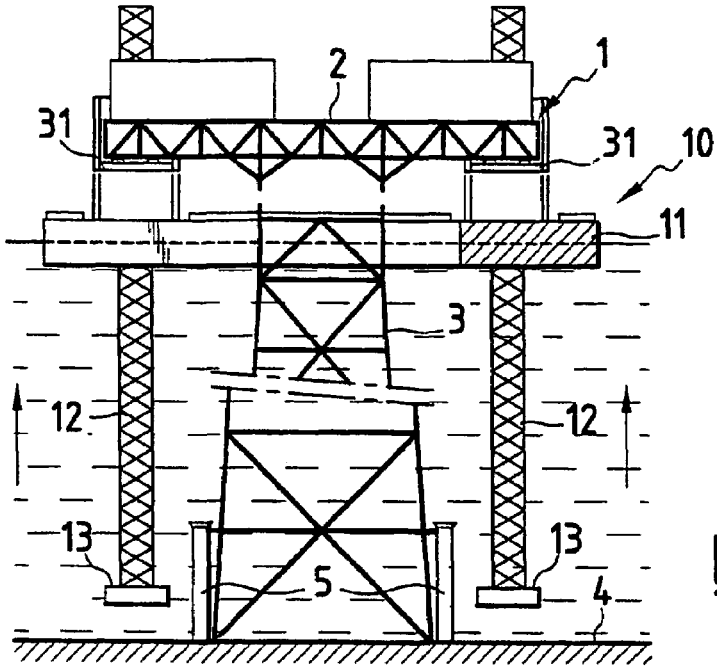
Figure 7F:
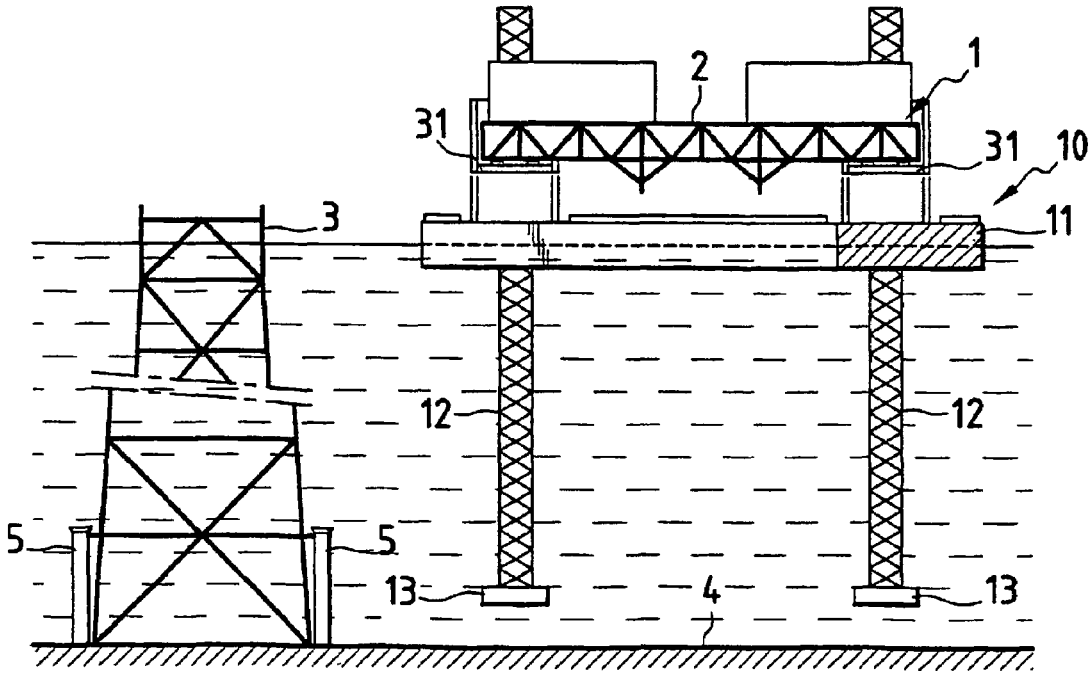

After these different operations, the hull 11 is lowered into floatation by reverse driving of the pinions 27, which engage with sets of teeth 22 (FIG. 7D). The pinions 27 continue to be rotationally driven, which causes the lifting legs 12 to rise by reaction due to the downward thrust of the hull 11 into the water (FIG. 7E). This allows the hull 11, supporting the deck 2 through the shuttle 30, to be removed from the production site, where the supporting column 3 remains in place, as shown in FIG. 7F.

Figure 7G:
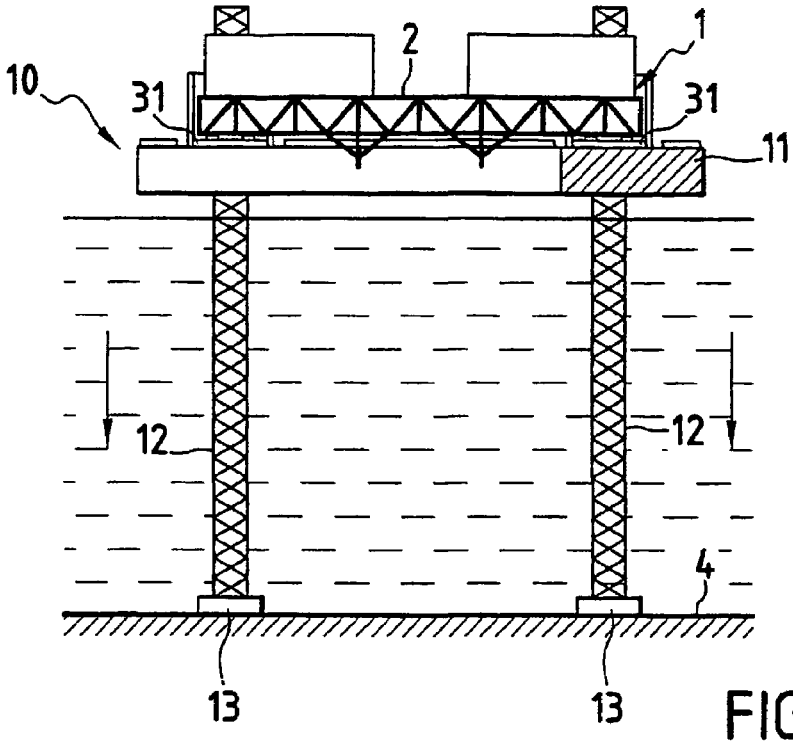
Figure 7H:
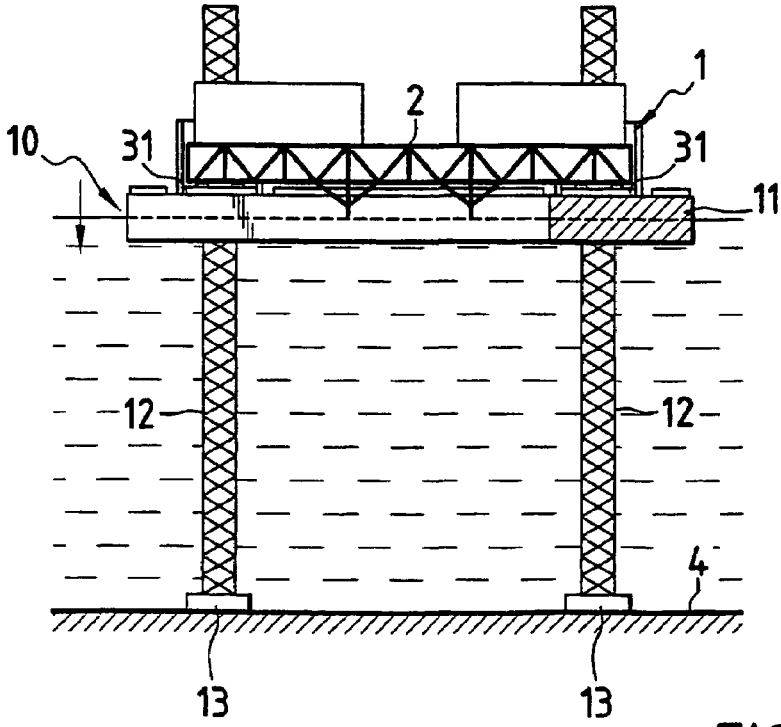

The lifting legs 12 are then relowered to bring the shoes 13 to bear on the seabed 4 and the hull 11 is raised by rotational driving of the pinions 27 to bring the hull 11 into contact with the units 31 of the shuttle 30 (FIG. 7G). These units 31 of the shuttle 30 are unlocked by returning the counterlocking racks 36 to their retracted position using cylinders 37. The combination comprising hull 11, shuttle 30 and deck 2 is lowered to bring the hull 11 into floatation, as illustrated in FIG. 7H.

During displacements of the shuttle 30 units 31 with respect to the hull 11, these units 31 are guided by flanges 34 on the vertical branch 32 and by the slideways 39 and 40.

During transport, lateral stabilization of the deck 2 is ensured by the cylinders 38 on each unit 31 of the shuttle 30, which are in contact with the lateral faces of the deck 2.

Figure 7I:
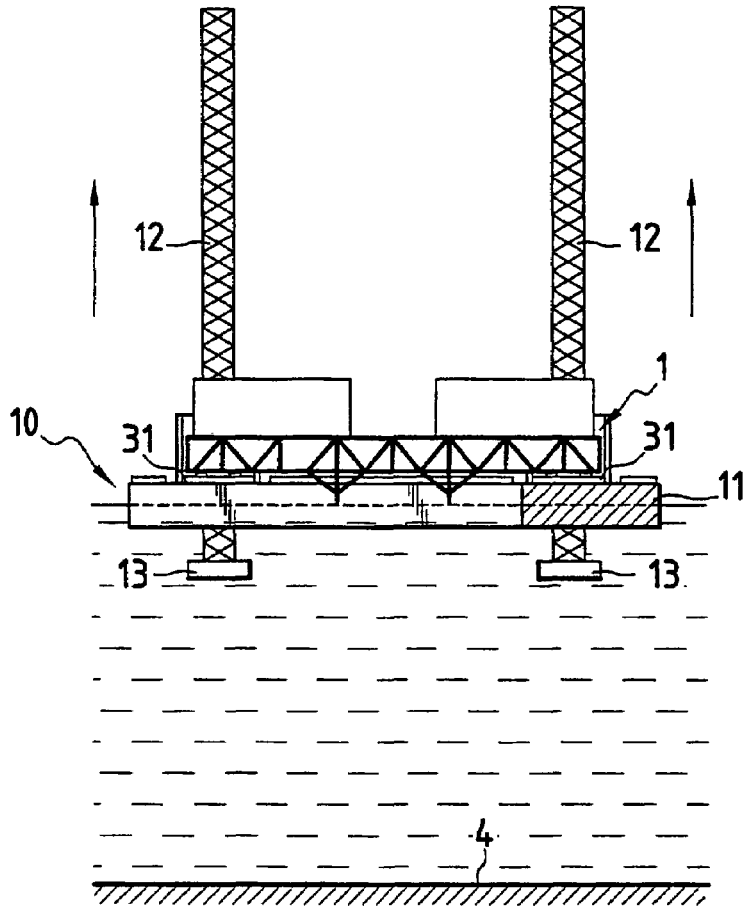
Figure 7J:
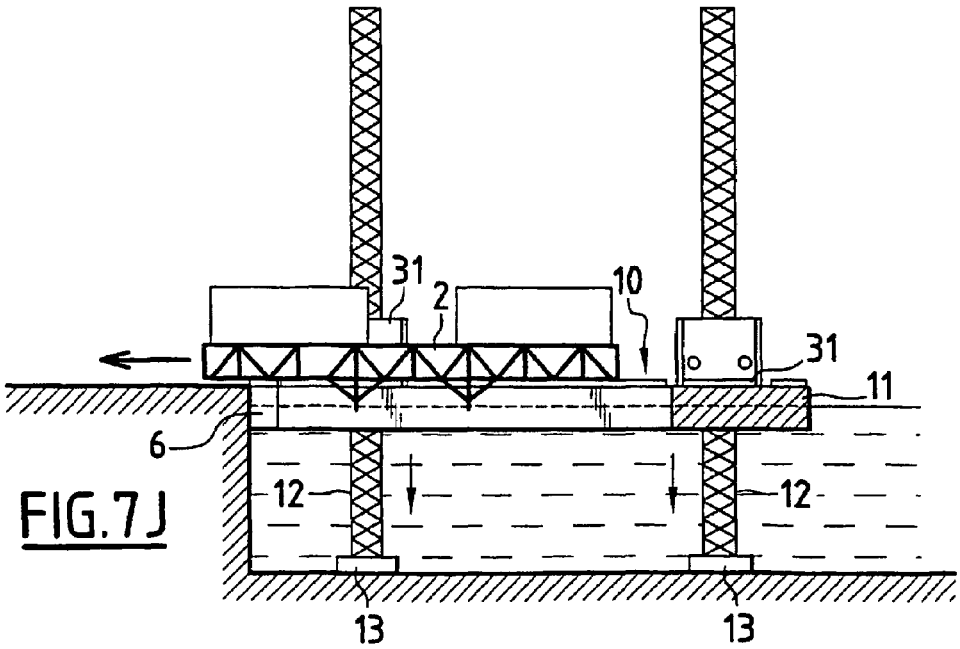

The hull 11 supporting the deck 2 is floated (FIG. 7I) to a port quay (FIG. 7J) and the lifting legs 12 are applied to the seabed to stabilize this hull 11. The cylinders 38 are retracted and a linkspan 6 is placed between the hull 11 and the quay to ensure continuity between the surface of this hull 11 and said quay. The deck 2 is then offloaded onto the quay, for example by sliding it on rails 42.

The deck 2 is transported by the structure 10 from the port quay to the production site by performing reverse operations which are mentioned in brief hereinbelow.

Firstly, the transport structure 10 is floated near to the quay and the lifting legs 12 are applied to the seabed to stabilize the hull 11. The link between the hull 11 surface and the quay is ensured by the linkspan 6 and the deck 2 is transferred from the quay onto the shuttle 30 units 31 by making it slide on the rails 42.

The deck 2 is then laterally stabilized on the units 31 of the shuttle 30 using cylinders 38 on each unit 31, the linkspan 6 is removed and the lifting legs 12 are raised.

The structure 10 supporting the deck 2 is floated near to the production site and the lifting legs 12 are applied to the seabed such that the deck 2 is lifted using the hull 11 and the shuttle 30.

The units 31 of the shuttle 30 are locked onto lifting legs 12 by means of counterlocking racks 36, which are actuated by the cylinders 37 such that these counterlocking racks 36 engage with adjacent teeth 22, thereby locking each unit 31 of the shuttle 30 onto the lifting legs 12.

The hull 11 is brought into floatation and the legs 12 of the structure 11 are raised. The deck 2 is positioned above the supporting column 3 of the oil platform 1 and the lifting legs 12 of the structure 10 are again applied to the seabed. The hull 11 is lifted to bring it into contact with the units 31 of the shuttle 30 and these units 31 are unlocked, then the hull 11, the shuttle 30 and the deck 2 are lowered to place this deck 2 on the supporting column 3.

The deck 2 is fixed to the supporting column 3, the hull 11 and the shuttle 30 are lowered to bring said hull 11 into floatation, then the lifting legs 12 are raised.

The structure 10 is then removed from the production site.

The structure according to the invention has the advantage of being able to transport directly the whole oil platform deck from the production site to a fixed site, where its disassembly can be undertaken safely and without risk of polluting the marine environment or vice versa, from a fixed site to a production site, where the deck is mounted on its supporting column.

Furthermore, the different transfer and transport stages can be performed without any ballasting operation, thereby achieving considerable time saving, which is significant in regions in which atmospheric conditions change very quickly.

Finally, operations involving the transfer of the deck from the transport structure to the quay and vice versa are facilitated because the transport structure hull is level with this quay.

The invention claimed is:

1. A combination of a deck of an offshore fixed oil production platform and a structure for transporting, commissioning and decommissioning of the deck, the combination comprising:

a supporting column operable to be anchored on the seabed when the platform is at a working location;

the deck supported by the supporting column when the platform is at the working location;

a hull constructed and configured for flotation and shaped to define an open space in the hull, the open space being positioned and configured to accommodate the supporting column therein when the hull is positioned below the deck;

lifting legs movably mounted on the hull, and operable to be lowered to rest upon the seabed;

a jackhouse supported by the hull, a displacement apparatus being housed in the jackhouse and associated with each lifting leg, the displacement apparatus being operable to displace the lifting legs;

a shuttle mounted on the hull and movable by the hull along the lifting legs, the shuttle being independent and separable from the jackhouse with the displacement apparatus and having a surface operable to engage a lower surface of the deck so as to support the deck on the shuttle to position the deck on the supporting column or remove the deck from the supporting column; and a locking device for locking the shuttle on the lifting legs.

2. The combination as claimed in claim 1, wherein the displacement apparatus comprise two opposing plates supported by the corresponding leg and each plate having lateral faces, both of the lateral faces having a set of teeth, at least two opposing units supported by the hull and each opposing unit comprising a pinion driven rotationally and operating in conjunction with one of the sets of teeth.

3. The combination as claimed in claim 1, wherein the shuttle is comprised of a respective independent unit for each of the legs, a guidance device respectively associating the respective one of the units with one of the legs, and lateral stabilization devices for stabilizing the deck in its support position.

4. The combination as claimed in claim 3, wherein each shuttle unit includes:

a vertical branch including a guidance device comprising part of a locking device which cooperates with a respective one of the legs for locking the shuttle unit in place on the associated leg; and a horizontal branch for supporting the deck.

5. The combination as claimed in claim 4, wherein the guidance device is comprised of two opposing flanges, each flange cooperating with the vertical branch, and a housing for one of the plates on the associated leg.

6. The combination as claimed in claim 4, wherein the locking device comprises at least one counterlocking rack, at least one actuation device displacing the rack between a retracted position and a locked position and in the locked position, the rack engaging one of the sets of teeth on the corresponding lifting leg.

7. The combination as claimed in claim 4, further comprising a first slideway on the jackhouse; each shuttle includes at least one second slideway mounted on the vertical branch and operable in conjunction with the first slideway mounted on the jackhouse.

8. The combination as claimed in claim 4, wherein the horizontal branch of each shuttle has a top face and includes elastic deck bearing devices on the top face of the horizontal branch of the shuttle.

9. The combination as claimed in claim 3, wherein the stabilization devices include at least one hydraulic or pneumatic horizontal displacement cylinder for each shuttle.

10. The combination as claimed in claim 1, wherein the hull includes rails for sliding the deck horizontally between a position with the deck supported on the shuttle and a storage position of the deck outside the shuttle.

11. The combination as claimed in claim 1, wherein the hull has an open part including a door movable from an open position for positioning the structure beneath the deck and a closed position during transport of the deck.

12. The combination according to claim 1, wherein the shuttle is movable upwardly by force transmitted from the hull as it is raised on the legs, and is movable by the force of gravity as the hull is lowered on the legs.

13. The combination as claimed in claim 1, wherein the hull is U-shaped, including opposed lateral sections and a link connecting the lateral section for defining the open space in the hull.

14. The combination as claimed in claim 1, wherein there are at least three of the lifting legs.

15. A method for decommissioning and transporting a deck of a fixed oil platform from a production site to a deck disassembly quay, the method comprising, in order:

providing a combined transport and lifting structure, which includes a floating hull fitted with hull lifting legs moveable vertically relative to the hull, and a shuttle which is movable relative to the lifting legs;

positioning the combined transport and lifting structure beneath the deck with the shuttle in a position also beneath the deck;

lowering the lifting legs into contact with the seabed;

raising the hull and the shuttle on the legs to bring the shuttle into contact with the deck;

separating the deck from a supporting column on which the deck is supported, further raising the shuttle on the legs to a position clear of the supporting column;

locking the shuttle in place on the lifting legs and laterally stabilizing the deck on the shuttle;

lowering the hull relative to the lifting legs to bring the hull into flotation, and thereafter to raise the legs off the seabed by reaction;

displacing the combined transport and lifting structure laterally to move the deck away from the supporting column;

lowering the lifting legs again to the seabed;

raising the hull on the lifting legs to bring the hull into contact with the shuttle;

unlocking the shuttle from the combined transport and lifting structure lifting legs so the shuttle is supported on the hull;

lowering the hull with the shuttle and the deck supported thereon by moving the hull relative to the lifting legs to bring the hull into flotation, thereafter to raise the legs off the seabed by reaction;

floating the combined transport and lifting structure with the deck supported thereon to the disassembly quay;

lowering the lifting legs at the quay to the seabed to stabilize the hull;

releasing the deck from the combined transport and lifting structure; and offloading the deck onto the quay.

16. A method according to claim 15, wherein the steps of raising the shuttle are performed by raising the hull on the lifting legs.

17. A method according to claim 15, wherein the hull is U-shaped and there are at least three of the lifting legs.

18. A method for transporting and commissioning a deck for fixed oil platform from a quay to a production site comprising, in order:

providing a transport structure including a floating hull fitted with hull lifting legs and a shuttle displaceable along the legs;

floating the transport structure to an operative position relative to the quay;

lowering the lifting legs relative to the hull to bring the legs into contact with the seabed to stabilize the hull;

operatively linking the hull and the quay;

transferring the deck from the quay to the transport structure such that the deck rests on the shuttle and laterally stabilizing the deck on the shuttle;

raising the lifting legs to bring the hull into flotation;

floating the transport structure to the production site;

lowering the lifting legs relative to the hull into contact with the seabed;

raising the hull and the shuttle on the legs with the deck supported on the shuttle;

locking the shuttle in place onto the legs;

lowering the hull to separate it from the shuttle and to bring the hull into flotation;

raising the legs relative to the hull;

positioning the deck above an oil platform supporting column and again lowering the legs relative to the hull in contact with the seabed;

raising the hull on the legs to bring the hull into contact with the shuttle;

unlocking the shuttle from the legs;

lowering the hull, the shuttle and the deck to place the deck on the supporting column;

securing the deck to the supporting column;

lowering the hull with the shuttle resting thereon to bring the hull into flotation;

raising the legs relative to the hull; and removing the transport structure from the production site.

19. A method according to claim 18, wherein the steps of raising the shuttle are performed by raising the hull on the lifting legs.

20. The method according to claim 18, wherein the hull is U-shaped and there are at least three of the lifting legs.

* * * * *